US006663412B2

(12) United States Patent
Aramoto et al.

(10) Patent No.: US 6,663,412 B2
(45) Date of Patent: Dec. 16, 2003

(54) STRUCTURE FOR INTERLOCKING CONNECTORS

(75) Inventors: Kiyoshi Aramoto, Higashiosaka (JP); Daichi Miyamoto, Nisshin (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/331,881

(22) Filed: Dec. 31, 2002

(65) Prior Publication Data

US 2003/0139082 A1 Jul. 24, 2003

(30) Foreign Application Priority Data

Jan. 21, 2002 (JP) ..... 2002-011062

(51) Int. Cl.[7] ..... H01R 13/627
(52) U.S. Cl. ..... 439/358; 439/357; 439/79
(58) Field of Search ..... 439/350, 352, 439/353, 357, 358, 351, 79

(56) References Cited

U.S. PATENT DOCUMENTS 3,926,497 A * 12/1975 Eigenbrode ..... 439/353
4,008,941 A * 2/1977 Smith ..... 439/358
4,944,693 A * 7/1990 Puerner ..... 439/358
5,281,161 A * 1/1994 Kanai ..... 439/357
6,146,179 A * 11/2000 Denny et al. ..... 439/352

FOREIGN PATENT DOCUMENTS

DE 3436968 A1 * 4/1986 ..... 439/358

* cited by examiner

*Primary Examiner*—Tho D. Ta
(74) *Attorney, Agent, or Firm*—Antonelli, Terry, Stout & Kraus, LLP

(57) ABSTRACT

A structure such that a socket connector manufactured less expensively can engage with a base connector more reliably, adapted to employment in high-voltage connectors of a reduced height. The socket connector (1) has a socket housing (2) in which socket contacts (12) secured on wire ends (11) are placed side by side. The base connector (21) is of a shape to be surface-mounted on a printed circuit board (20). The socket housing (2) has a pair of lock arms (6) extending forwards from a rear end of and along lateral sides (4) of the socket housing. The socket housing further has tie pieces (5) capable of elastic deformation and formed integral with the lateral sides so as to support and operatively connect the lock arms (6) to the socket housing. The lock arms (6) have fore ends formed integral with hooks (7) projecting inwards and towards each other, and the lock arms (6) further have push lugs (8) extending backwards from their rear ends so as to be located in rear of the tie pieces (5). When engaging the connectors one with the other, the lock arms (6) will be guided forwards along respective sides (25) of the base housing (22) until latched in place by and with the rear edge of this housing.

3 Claims, 4 Drawing Sheets

STRUCTURE FOR INTERLOCKING CONNECTORS

FIELD OF THE INVENTION

The present invention relates to a structure for causing a base connector to interlock with a socket connector having wire ends secured thereto, wherein the base connector is surface mounted on a printed circuit board.

PRIOR ART

Examples of such a locking structure have been known in the art as disclosed in the specifications and drawings of U.S. Pat. Nos. 4,008,941 and 4,376,565. In each of those prior art structures, a socket housing has lock arms respectively disposed on its lateral sides. Each lock arm has at its distal end a hook capable of engaging with the corresponding one of detents that protrude from lateral sides of a base housing. Those lock arms further comprise certain push portions that will be pressed to release the hooks off the detents so as to break the interlocking relationship between said connectors.

It is however noted that those detents protruding sideways from the lateral sides of the base housing have inevitably caused an undesirably large overall size. Thus, it has considerably been difficult to render more compacted the couple of such connectors.

SUMMARY OF THE INVENTION

The present invention was made in view of these prior art structures, and its object is to provide a structure for interlocking connectors such that they can be made smaller in size, can engage one with another more reliably and can be manufactured less expensively. In particular, this structure provided herein must be adapted for employment in the shortish types of high-voltage connectors each having a reduced height.

In order to achieve the object, the present invention provides a structure for interlocking connectors, one of them being a socket connector that has a flat socket housing in which disposed side by side are socket contacts secured on respective wire ends. The other connector is a base connector of a shape to be surface mounted on a printed circuit board and comprising a flat box-shaped base housing for engagement with the socket housing, the base housing having a rear edge, similarly to the structure of this kind known in the art. Also similarly to the prior art, the socket housing in the invention has a pair of lock arms extending forwards from a rear end of the socket housing, and along lateral sides thereof. Tie pieces capable of elastic deformation and formed integral with the lateral sides of the socket housing do support and operatively connect the lock arms to said lateral sides. However, it is a characteristic feature of the present invention that the lock arms have their fore ends respectively formed integral with hooks projecting inwards and towards each other. Push lugs integrally extend backwards from rear ends of the lock arms so as to be located rearwardly of the tie pieces. When engaging the connectors one with the other, the lock arms of the socket housing will be guided forwards along respective sides of the base housing until latched firmly in place by and with the rear edge thereof.

In a case wherein the interlocking structure is applied to a high-voltage connector assembly, each lock arm preferably has a fore extension protruding rearwardly of the rear edge of the base housing. Such fore extensions will protect sides of an array of leads that extend from respective pin contacts and project beyond said rear edge of the base housing. This structural feature will increase the linear distance between each pin contact and any electronic device located adjacent thereto, particularly between the pin contact's lead and said device, so as to improve the connector assembly in its resistance to high voltages. Preferably, each lock arm having and including such an integral fore extension is generally of the same height as the base housing.

Also preferably, the lock arms of the socket housing respectively have rear extensions formed integral therewith. These extensions may project beyond a rear edge of the socket housing, such that these rear extensions having the push lugs formed integral therewith will also serve to protect sides of a group of the wire ends secured to and protruding from socket connector. Such elongated lock arms will make it easier to open or close the lock arms relative to the base housing.

THE PREFERRED EMBODIMENTS

Figure 1:
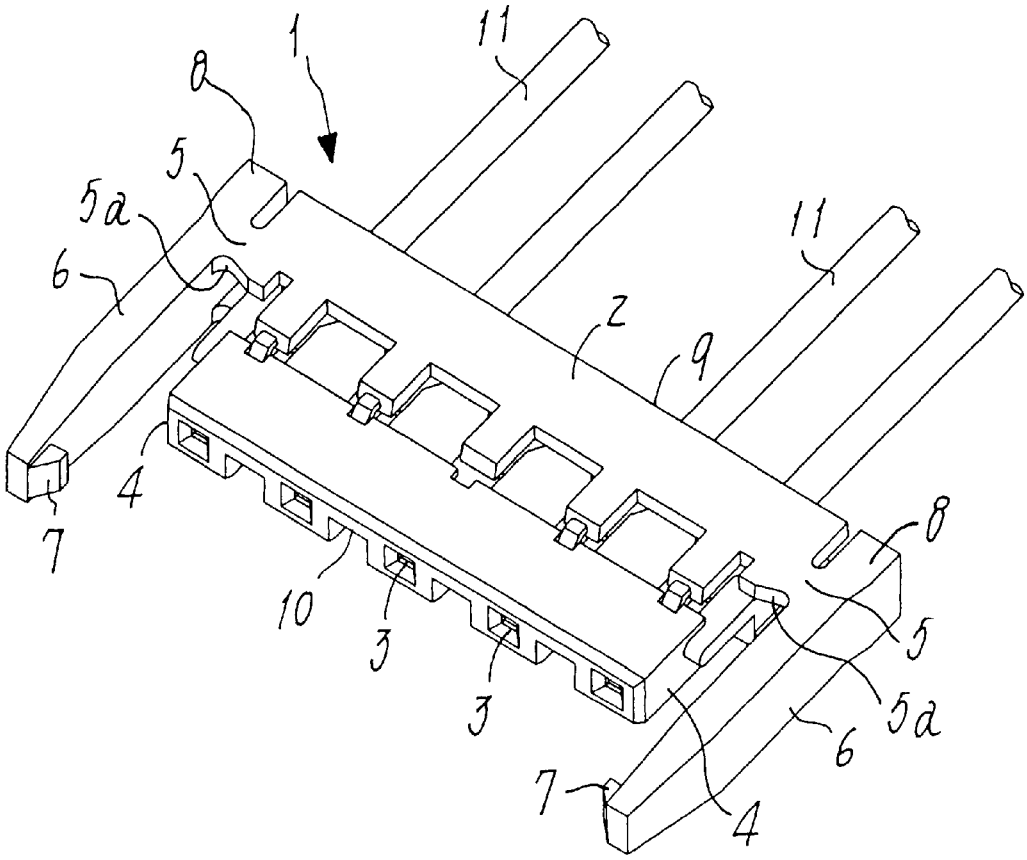
FIG. 1 is a perspective view of a socket connector involved herein.

Now some embodiments of the present invention will be described in detail, referring to the drawings.

Figure 2:
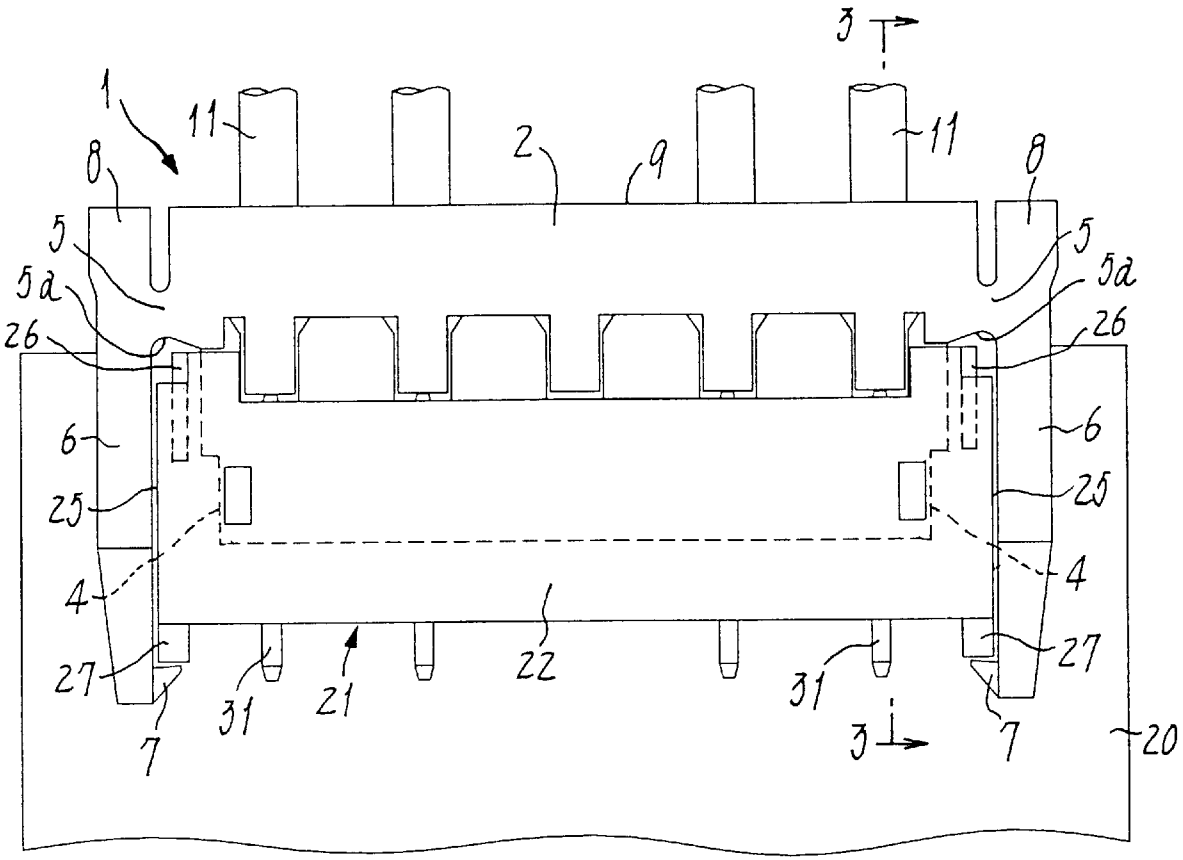
FIG. 2 is a plan view of the socket connector put into a fixed engagement with a base connector, duet to an interlocking structure of the present invention.

A socket connector involved in the present invention is shown as a perspective view thereof in FIG. 1 and generally indicated at the reference numeral 1. As seen in FIG. 2 that is a plan view, the socket connector 1 is to be fitted on a mating base connector 21 that has been surface mounted on a printed circuit board 20. These connectors are shown from another aspect in FIG. 3 that is a cross section taken along the line 3—3 in FIG. 2.

As seen in FIG. 1, the socket connector 1 comprises a socket housing 2 that is of a flat and rectangular shape elongated sideways. Compartments 3 are rectangularly cylindrical portions arranged side by side and at regular intervals in the socket housing 2 so as to accommodate therein socket contacts 12 separated from each other (see FIG. 3). Each contact 12 is secured to one of wire ends 11, with each compartment being a unit shaped to be a square cylinder. The socket housing 2 has opposite lateral sides 4 and 4, and tie pieces 5 and 5 respectively formed integral therewith are capable of elastic deformation in a plane that includes such a flat housing. A pair of lock arms 6 and 6 respectively continuing from the tie pieces 5 and 5 are thus integral with the socket housing 2. Each lock arm 6 extends from a rear edge 9 of the socket housing, along the side 4 and forwards beyond a fore edge 10 of this housing. A hook 7 facing inwards is formed integral with a fore end of each lock arm 6. The tie pieces 5 each projecting sideways from the side 4 are located near the rear edge 9 of said socket housing 2, so that a rearmost end of each lock arm 6 is formed as a push lug 8 disposed rearwardly of the tie piece 5. The fore face 5*a* of each tie piece is composed of a tapered region and a convex region continuing therefrom. This is for the purpose of facilitating the tie piece to reversibly make an elastic and smooth deformation without any local stress imparted to the lock arm 6 being opened or closed. Such a fore face 5*a* of the tie piece 5 may alternatively be a simple concave region also effective to ensure a uniform distribution of stress.

Figure 3:
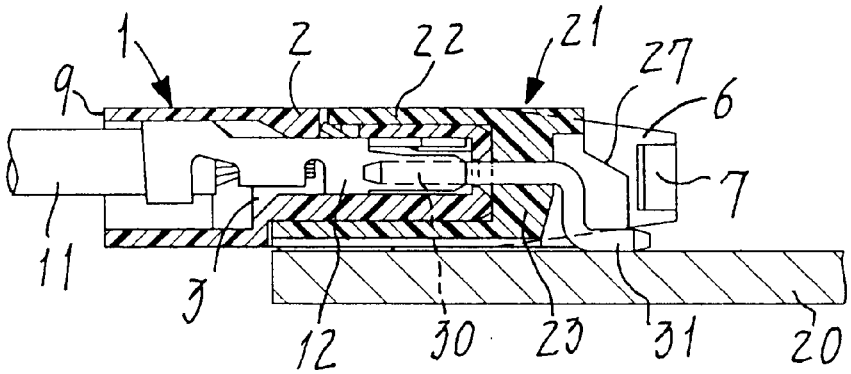
FIG. 3 is a cross section taken along the line 3—3 in FIG. 2.

On the other hand, a base housing 22 of the base connector 21 surface-mounted the printed circuit board 20 is of a structure and shape as shown in FIGS. 2 and 3. The base housing 22 is generally a flat box having an open fore wall and a closed rear wall 23. Pin contacts 30 are embedded each in part in this housing 22, due to the insert-molding process employed to form this connector 21. Each pin contact 30 penetrating the rear wall 23 has a lead 31 projecting rearwards therefrom. This lead 31 is bent into an L-shape adapted for the soldering thereof to the printed circuit board 20. Lateral sides 25 and 25 of this housing have reinforcement metals 26 and 26 respectively embedded in the fore regions of said sides 25, such that each metal 26 has a fore end exposed to be soldered to the printed circuit board 20. Further, a pair of protrusions 27 and 27 are in alignment with the respective sides 25 and 25 are formed integral with the rear wall 23 so as to jut out rearwardly thereof.

The socket connector 1 with the socket contacts 12 secured to the wire ends 11 and held in the compartments 3 will be fitted on and engaged with the base connector surface-mounted on the circuit board 20, in a manner as will be seen in FIGS. 2 and 3. In detail, an operator may use his or her fingers to press inwards the push lugs 6 so that the forward regions of lock arms 6 will be displaced a little distance away from each other. Subsequently, these lock arms 6 will be guided along the respective sides 25 of the base housing 22, until the socket housing 22 fits in the open fore wall of base housing 22. Thus, the socket contacts 12 fit on the respectively mating pin contacts 30 to establish electric connection therewith. At the same time, both the hooks 7 on the lock arms 6 are latched by the protrusions 27 projecting from base housing 22, whereby these arms 6 will firmly grip this housing 22 to thereby cause these connectors 1 and 21 to interlock one with another.

When pulling the socket connector 1 out of the base connector 21, the push lugs 8 of lock arms 6 will be pressed towards each other with the operator's fingers so as to release the hooks 7 from the protrusions 27 of base connector. With the lock arms being kept for a while at this position, they 6 will be retracted back along the sides 25 of base housing 22 in order to easily and smoothly withdraw and remove the socket housing 2 from the base housing.

It will be understood that those protrusions 27 can be dispensed with, if the hooks 7 on lock arms 6 are shaped to directly catch the rear edge of base housing 22 so as to be locked thereby.

Figure 4:
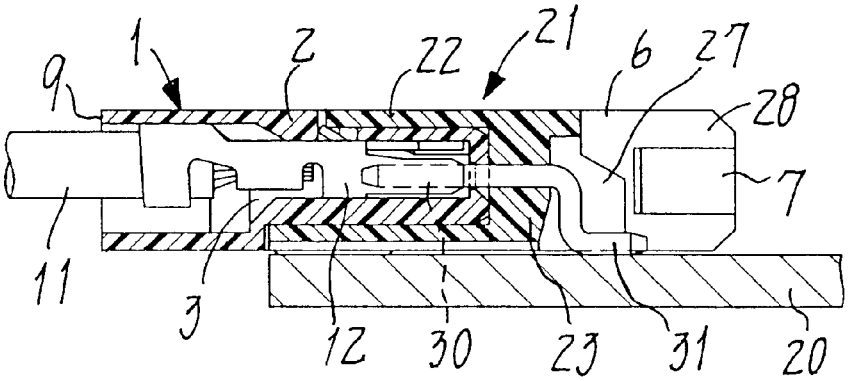
FIG. 4 is a cross section corresponding to FIG. 3 but showing another embodiment of the invention.

FIG. 4 shows a case wherein the interlocking structure of the invention is preferably applied to high-voltage connectors. In a second embodiment employed in this case, the lock arms 6 have each a fore extension 28 projecting from the base housing's 22 rear wall a longer distance than in the first embodiment. Each lock arm 6 having such an extension 28 is of a height substantially equal to that of said base housing 22 in order to protect the side of the lead 31 of each pin contact 30. Linear distance between each lead 31 and any adjacent electronic device on the printed circuit board 20 will thus be increased to improve these connectors' resistance to high voltages.

Figure 5:
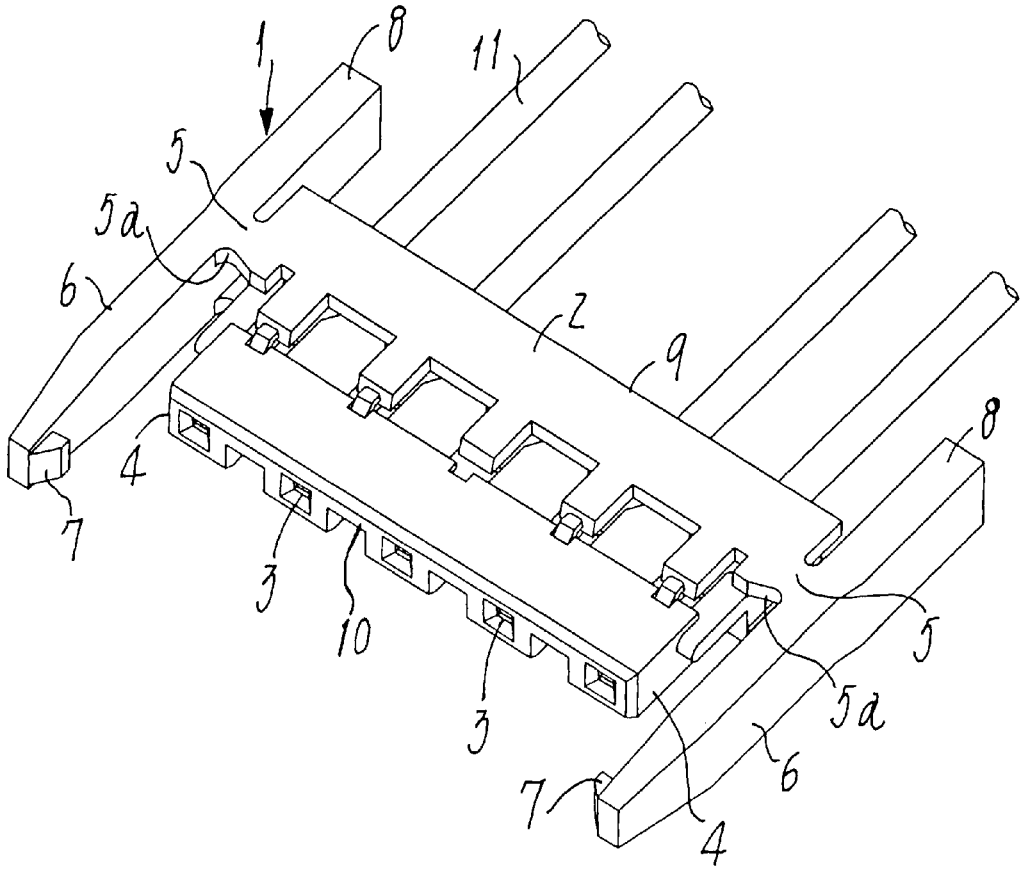
FIG. 5 is a perspective view of the socket connector in still another embodiment.

FIG. 5 shows another type of the socket connector provided in accordance with a third embodiment. In this case, each lock arm 6 has a rear extension projecting a considerable distance beyond the rear wall of socket housing 2. The rear extensions will thus function as push lugs 8 that do not only facilitate the opening and closing of lock arms 6 with use of the operator's fingers, but also provide a better protection to the wire ends 11.

In summary, the pair of elongated lock arms extending along the sides of socket housing will slide along the respective sides of a base housing, so that these connectors can easily and smoothly fit one on another to establish an electic connection, without fear of any torsional mutual engagement. The socket housing's lock arms strongly grip the base housing, ensuring a reliable locking thereof in said socket housing.

The hooks on the socket housing's lock arms are designed to be directly latched by a rear edge itself, or indirectly by its rearward but non-sideways protrusions of the base housing. Any lugs or protrusions projecting sideways need no longer be formed on the lateral sides of said base housing. Any existing types of base connectors lacking in such sideways lugs or protrusions can now be employed herein to rendering less expensive the interlocking structure of the invention.

What is claimed is:

1. A structure for interlocking connectors, one of them being a socket connector having a flat socket housing in which disposed side by side are socket contacts secured on respective wire ends, with the other connector being a base connector of a shape to be surface-mounted on a printed circuit board and comprising a flat box-shaped base housing for engagement with the socket housing, the base housing having a rear wall and rear edge, and contacts within the flat box-shaped base housing, each contact having a lead portion extending rearward from the rear wall and being adapted for soldering to the printed circuit board, the socket housing having a pair of lock arms extending forwards from a rear end of the socket housing, and along lateral sides thereof, the socket housing further having tie pieces capable of elastic deformation and formed integral with lateral sides of the socket housing so as to support and operatively connect the lock arms thereto, the lock arms having their fore ends respectively formed integral with hooks projecting inwards and towards each other, the lock arms having fore extensions protruding rearwardly of the rear edge of the base housing and rearwardly beyond a rear end of the lead, such that the fore extensions protect sides of the leads respectively extending rearward beyond the rear wall of the base housing, and the lock arms further having push lugs integrally extending backwards from rear ends of the lock arms so as to be located rearwardly of the tie pieces, wherein when engaging the connectors one with the other, the lock arms of the socket housing are guided forwards along respective sides of the base housing until latched in place by and with the rear edge thereof.

2. A structure for interlocking connectors as defined in claim 1, wherein each lock arm having and including the integral fore extension in the socket housing is substantially of the same height as the base housing.

3. A structure for interlocking connectors as defined in claim 1, wherein the lock arms of the socket housing respectively have rear extensions formed integral therewith and extending beyond a rear edge of the socket housing, such that the rear extensions having the push lugs formed integral therewith do serve to protect sides of the wire ends secured to and protruding rearwards from the socket connector.

* * * * *